US006875062B2

(12) United States Patent
Bouley et al.

(10) Patent No.: US 6,875,062 B2
(45) Date of Patent: Apr. 5, 2005

(54) ELASTIC CONNECTION TERMINAL

(75) Inventors: Pierre Bouley, Dijon (FR); Guy Eschermann, Chevigny-Saint-Sauveur (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/686,253

(22) Filed: Oct. 16, 2003

(65) Prior Publication Data

US 2004/0082229 A1 Apr. 29, 2004

(30) Foreign Application Priority Data

Oct. 17, 2002 (FR) ..... 02 13127

(51) Int. Cl.[7] ..... H01R 4/48
(52) U.S. Cl. ..... 439/834; 439/828
(58) Field of Search ..... 439/834, 835, 439/441, 828

(56) References Cited

U.S. PATENT DOCUMENTS 5,879,204 A * 3/1999 Delarue et al. ..... 439/835
6,010,376 A * 1/2000 Kollmann ..... 439/834
6,283,801 B1 * 9/2001 Guinda et al. ..... 439/835
6,350,162 B1 * 2/2002 Despang ..... 439/835
6,464,545 B2 * 10/2002 Yano ..... 439/828

FOREIGN PATENT DOCUMENTS

| | | |
|---|---|---|
| DE | 33 46 027 A1 | 7/1985 |
| DE | 298 19 517 U1 | 2/1999 |
| DE | 299 11 123 U1 | 9/2000 |
| DE | 2000 09 541 U1 | 11/2001 |
| EP | 1 052 752 A1 | 11/2000 |

* cited by examiner

*Primary Examiner*—Tho D. Ta
(74) *Attorney, Agent, or Firm*—Parkhurst & Wendel, L.L.P.

(57) ABSTRACT

Elastic connection terminal for an electric switch or junction device, comprising an elastic loop placed on a conducting part and an auxiliary part capable of forming a stop for the end of the cable.

The assembly and behaviour of the terminal are improved by placing an auxiliary part 30 in contact with the back of the support strip 18 of the conducting part 14. The part 30 is provided with at least on attachment element, for example a lug 34, engaged with the connection region of the support strip, and guide panels for the cable. The guide panels extend close to the connection area and they have a slope adapted to the curved shape of the loop 20 so as to guide it.

6 Claims, 3 Drawing Sheets

ELASTIC CONNECTION TERMINAL

This invention relates to an elastic connection terminal for an electric switch or junction device, the terminal comprising a conducting part provided with a pressure strip at one end for an elastic loop that will clamp at least one cable.

In this type of terminal, an elastic loop is usually provided with a fitting arm, a clamping arm and a bent part connecting the fitting arm and the clamping arm. The fitting arm is applied on the front of the support strip to come into contact with the conducting part, while the clamping arm is provided with a window arranged to trap a cable inserted through an opening in a casing or a cover of the switch or junction device. More precisely, the cable is trapped between a moving edge of the window and a connection region on the back of the support strip; the cable is released by applying pressure on the bent part of the loop using a tool or an interconnection pin.

This type of terminal is described in document EP 1 052 729, and comprises an auxiliary part that limits bending of the loop and that can form a stop for the cable. The cable is inserted into this terminal using a guide that could be improved. Furthermore, cable forces during insertion cause the auxiliary part to float, and there is even risks of breaking it.

The purpose of the invention is to improve the guidance, support and insulation of the cable for this type of terminal, while maintaining satisfactory behaviour of the elastic loop and good cohesion of its assembled component parts.

According to the invention, the auxiliary part is brought into contact with the back of the support strip and is provided with at least one attachment element gripping the support strip, for example in its connection region. The result is good behaviour of the terminal in the switch or junction device, particularly under the effect of forces or shocks applied during manoeuvres of the cable and the tool.

The auxiliary part preferably has cable guide and insulation panels extending as far as the connection region for the conducting part and they are provided with a guide slope adapted to the curved shape of the loop clamping arm. The attachment elements may be lugs provided at the ends of guide panels located close to the clamping arm of the elastic loop.

The conducting part can advantageously be provided with a slit and the bottom of the auxiliary part may be provided with a tongue, the tongue passing through the slit to project on the front side of the support strip. The tongue thus defines a holding strip or a stop strip to limit sliding of the loop. The tongue may also be provided with a click fit or similar element that helps to hold the auxiliary part assembled to the conducting part.

An independent part for protection of the auxiliary part may advantageously be housed in the loop, being arranged in a manner known in itself to limit bending of the loop.

The following detailed description refers to an embodiment of the invention given as a non-limitative example and represented by the attached drawings.

FIG. 1 diagrammatically shows a side view of a terminal according to the invention.

The elastic connection terminal 10 illustrated in the figures is associated with or included in an electric switch or junction device 11 such as a contactor, circuit breaker, junction block, terminal block or other analogue electrical device facilitating fast connection. The terminal 10 is placed in an appropriate compartment 12 in the switch body or housing 13.

Figure 1:
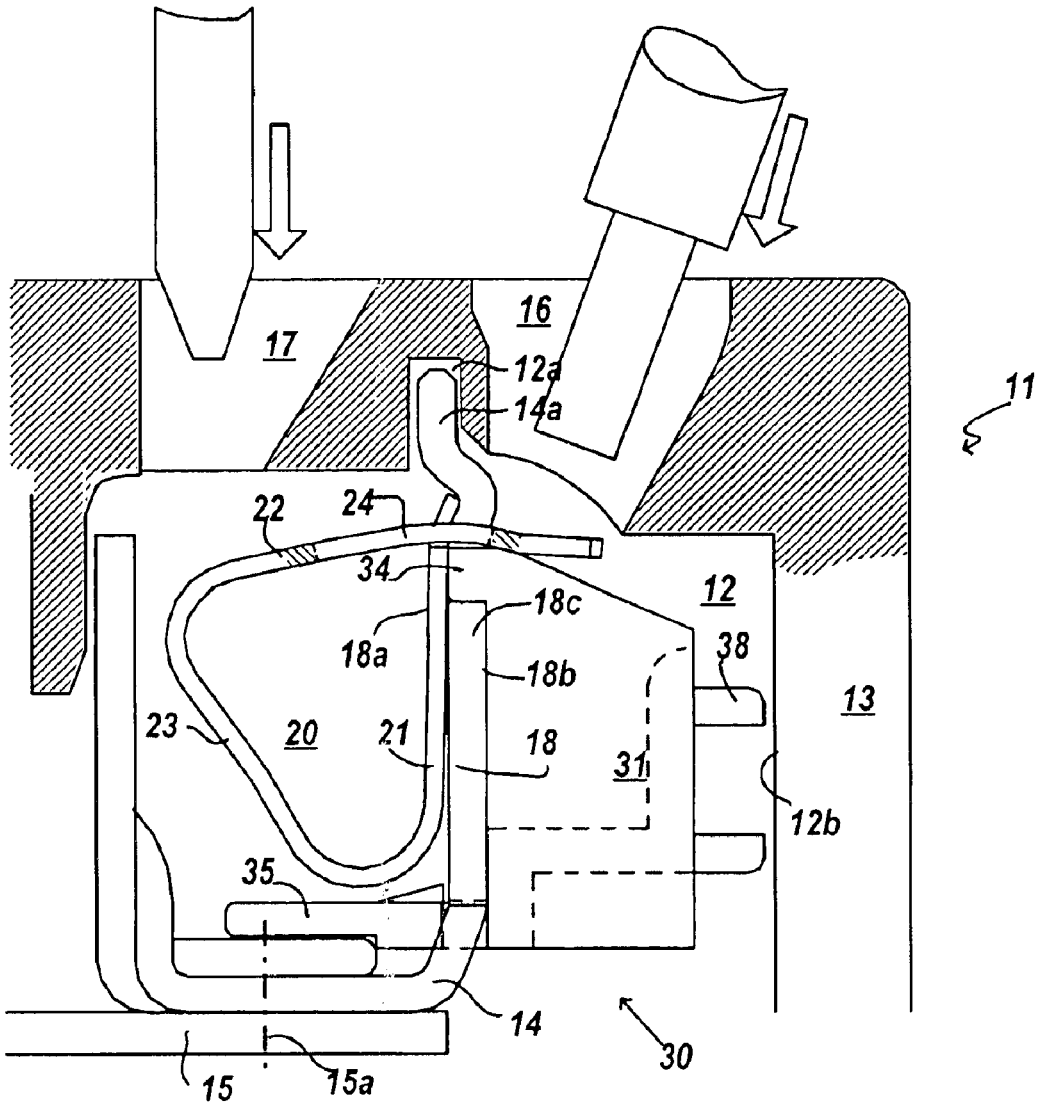
Figure 2:
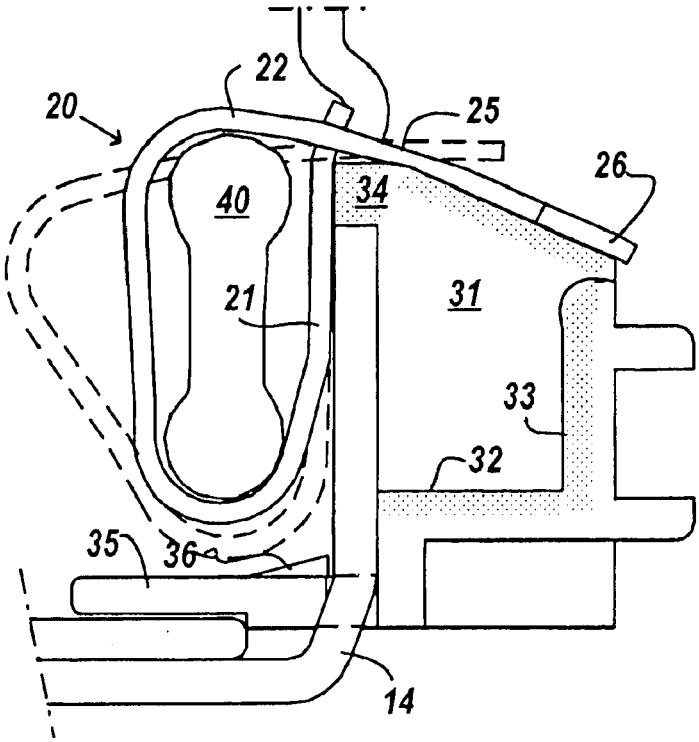
FIG. 2 shows a similar view of the elastic loop in the unclamped position.

The terminal comprises a known type of elastic loop 20 installed on a conducting part 14 specific to the switch or junction device 11, for example the conducting part being inserted in or fixed in the housing 13 of the switch or junction device. In this case, the part 14 is fixed to a connection strip 15 by a screw 15*a* (illustrated by its centre-line in FIG. 1), the part 14 and/or the strip 15 being fixed to the housing by any means. The compartment 12 communicates with the outside of the housing 13 through an opening 16 in the form of a funnel into which a conducting cable stripped at the end is inserted, and an opening 17 through which a releasing tool or a connection conducting pin can be inserted.

Figure 3:
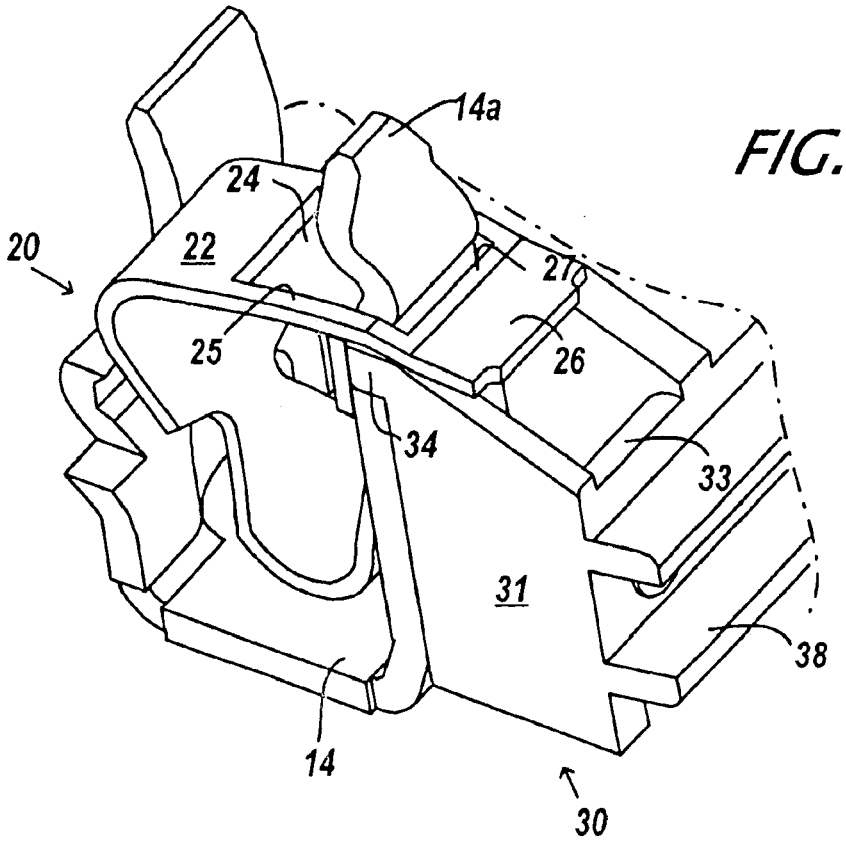
FIG. 3 shows a perspective front view of the terminal according to the invention.

Loop 20 provides a fitting arm 21 and a clamping arm 22 connected to each other through a bent part 23. The loop 20 is placed on a fixed support strip 18 of the conducting part 14 that has a front side 18*a* and a back side 18*b*. In more detail, the fitting arm 21 is applied to the front 18*a*, while the clamping arm 22 is provided with a window 24 defined laterally by two segments 25, and near the free end of the arm 22, by an end tongue 26 so that a clamping stop 27 comes into place facing the back side 18*b* (see FIG. 3).

Figure 4:
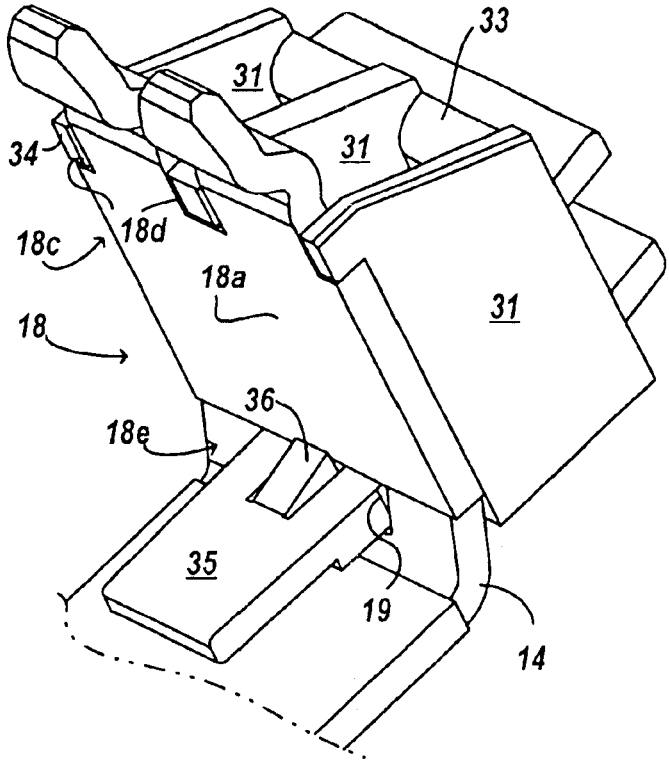
FIG. 4 shows a partial rear perspective view of a double terminal, similar to the terminal in FIG. 3.
Figure 5:
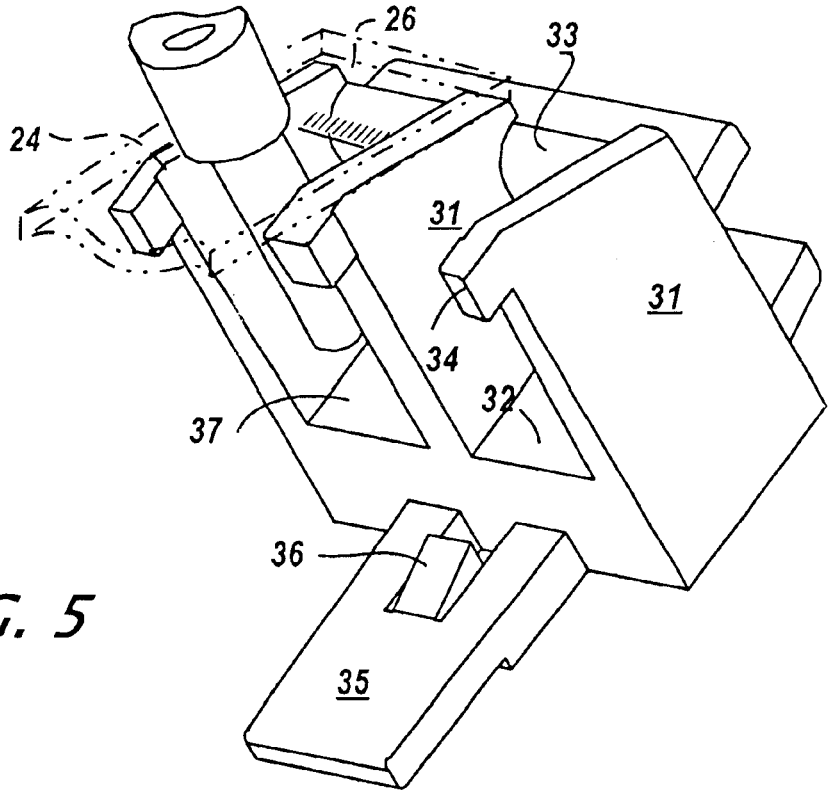
FIG. 5 shows a perspective view of the auxiliary part of the terminal in FIG. 4.

An auxiliary part 30, designed to perform cable guide, stop and insulation functions, is applied in contact with the back 18*b* of the support strip 18. The auxiliary part 30 has cable guide panels 31, a bottom stop 32 for the cable and a back wall 33. There are also lugs 34 or similar attachment elements near the top and projecting forwards that fit onto the conducting part 14, and near the bottom there is at least one tongue 35 that penetrates into a slit 19 of the part 18. The lugs and the tongue put the auxiliary part 30 into position and hold it on the part 14. The tongue 35 acts as a bottom stop for the elastic loop, and it is provided with a click fit element (or an insertion element) 36 that holds the part 30 assembled to the support strip 18. Stops 38 are provided at the back of the part 30 in the form of ribs or pins cooperating with a face 12*b* of the compartment 12. It can be seen that the panels 31 cooperate with the bottom 32 and the back wall 33 to form an individual compartment 37 for the stripped end of the cable, in particular for guidance functions and providing interphase insulation when several wires are connected in adjacent terminals for different phases (for example see FIGS. 4 and 5). This space also protects the electrical terminal against the harmful effects caused by the entry of polluting materials.

The panels 31 of the auxiliary part 30 are applied through plane faces onto the corresponding plane face of the back 18*b* of the part 14, close to the clamping arm 22 of the loop. They are provided with attachment or click fit elements just below this arm 22 (FIGS. 1–4). In this case, attachment lugs 34 are used that fit into notches 18*d* located near the top of the part 14 close to the end of the support strip 18 in its connection region 18*c*. Obviously, different shapes of cooperating elements with the same attachment or click fit function can be used instead of the lugs 34 and notches 18*d*. The panels 31 aligned with the lugs 34 have a special shape, for example with a downwards slope, adapted to the sloping or curved shape of the arm 22 and its pivoting movement, to facilitate its guidance. The tongue 35 is placed orthogonal to the direction in which the cable is inserted and passes through the slit 19 provided in the region 18*e* of the strip 18 opposite its connection region 18*c* (see FIG. 4).

The compartment 37 determined by the bottom 32, the panels 31 and the wall 33 guides the end of the cable after it projects out of the funnel, and helps to house the end of the cable. The insertion or click fit element 36 cooperates with the lugs 34 to provide a rigid and strong assembly of the auxiliary part 30 with the conducting part 14. A protection part 40, independent of the auxiliary part 30, is placed inside the loop to limit compression of the loop.

The terminal described is used as follows. A manoeuvring tool or pin is inserted in the opening 17 to press on the outside of the bent part 23 and thus put the elastic loop in the relaxed position (in solid lines on FIG. 2). As a result, the edges of the tongue 26 and the side segments 25 of the clamping arm 22 slide on the slopes of the guide panels 31. A cable, for example a multi-strand cable is then presented in front of the opening 16 and is inserted in it, the slope of the funnel bringing the stripped end of the cable into contact with the back 18*b* of the support strip 18 in its connection region 18*c*. The end of the cable is guided firstly by the back 18*b* of the strip 18, and secondly laterally by the panels 31, until it is stopped by the bottom 32. Note that the cable inserted in its compartment 37 remains insulated from a cable inserted in a compartment 37 adjacent to it by the intermediate panel 31 that forms a partition.

Thrust forces applied to the auxiliary part 30 when the cable is inserted are resisted at the top by the upper part (in the figures) of part 14 by means of the lugs 34 engaged in notches 18*d* and at the bottom by the tongue 35 cooperating with the slit 19. Tangential thrust forces applied to part 14 when the tool inserted in the opening 17 presses the part 23 of the loop 20 are resisted by the housing 13, firstly by means of a slit 12*a* that houses the end tongue 14*a* of part 14, and secondly by the front 12*b* of the compartment 12, into which the stops 38 of the part 30 come into contact.

What is claimed is:

1. An elastic connection terminal for an electric device, said device comprising a conducting part located at one end thereof and comprising a support strip having a front face and a back face comprising a connection region, the terminal for being fastened to the support strip and comprising:

an elastic loop comprising a fitting arm, a cable clamping arm and a bent part connecting the fitting arm and the clamping arm, the fitting arm for abutting the front of a support strip of an electric device and being in contact with a conducting part of an electric device, said clamping arm having a window for clamping a cable between the back face of such support strip and an edge of the window; and an auxiliary part for stopping one end of a cable inserted into the terminal, wherein the auxiliary part is for being brought into contact with the back face of a support strip of an electric device and comprises at least one attachment element for gripping a region of such a support strip, thereby joining with such a conducting part of an electric device, and guide panels, the panels for extending to a connection region of a support strip of an electric device and comprising attachment elements located adjacent such a connection region, wherein the guide panels each have an end portion having a profile for slidingly receiving the clamping arm.

2. The terminal according to claim 1, wherein the auxiliary part further comprises a back wall, wherein the guide panels are for abutting a support strip of an electrical device together with the back wall to define an individual compartment for an individual cable, each compartment being electrically isolated from an adjacent compartment.

3. The terminal according to claim 1, further comprising a protective part located in the elastic loop and for limiting bending of the elastic loop, the protective part being independent of the auxiliary part.

4. The terminal according to claim 1, wherein the auxiliary part comprises at least one stop for cooperating with a stop face of a housing of an electric device.

5. The terminal according to claim 1, wherein the auxiliary part comprises a bottom comprising an assembly tongue for limiting movement of said elastic loop, said tongue for passing through a slit of such a conducting part of an electric device to project on the front side of a support strip of such an electric device.

6. The terminal according to claim 5, wherein the tongue comprises a click-fit element for connecting the auxiliary part to a conducting part of an electric device.

* * * * *